US007393000B2

(12) United States Patent
Resch et al.

(10) Patent No.: US 7,393,000 B2
(45) Date of Patent: Jul. 1, 2008

(54) COUPLING DEVICE

(75) Inventors: Franz Resch, Schladming (AT); Helmut Holzer, St. Johann (AT)

(73) Assignee: ATOMIC Austria GmbH, Altenmarkt im Pongau (AT)

( * ) Notice: Subject to any disclaimer, the term of this patent is extended or adjusted under 35 U.S.C. 154(b) by 0 days.

(21) Appl. No.: 11/497,119

(22) Filed: Aug. 1, 2006

(65) Prior Publication Data

US 2007/0145720 A1 Jun. 28, 2007

(30) Foreign Application Priority Data

Aug. 8, 2005 (AT) ..... A 1334/2005

(51) Int. Cl.
*A63C 5/00* (2006.01)

(52) U.S. Cl. ..... 280/604; 280/612; 280/623

(58) Field of Classification Search ..... 280/604, 280/612, 623
See application file for complete search history.

(56) References Cited

U.S. PATENT DOCUMENTS

| | | | | |
|---|---|---|---|---|
| 4,210,342 | A | 7/1980 | Krob et al. | |
| 4,272,099 | A | 6/1981 | Svoboda et al. | |
| 4,305,604 | A | 12/1981 | Leichtfried | |
| 5,261,688 | A | 11/1993 | Rohrmoser | |
| 5,498,017 | A * | 3/1996 | Rohrmoser | 280/633 |
| 6,471,235 | B1 * | 10/2002 | Luitz et al. | 280/618 |
| 2001/0010421 | A1 | 8/2001 | Bardin | |
| 2001/0048213 | A1 * | 12/2001 | Thomas et al. | 280/611 |

FOREIGN PATENT DOCUMENTS

| | | |
|---|---|---|
| AT | 345136 | 12/1977 |
| AT | 376131 | 3/1984 |
| DE | 78 05 344 | 2/1978 |
| DE | 30 00 739 | 8/1980 |
| DE | 41 35 899 A1 | 6/1992 |
| DE | 42 30 392 A1 | 4/1993 |
| DE | 100 39 816 A1 | 3/2001 |
| EP | 1121960 | 8/2001 |

* cited by examiner

*Primary Examiner*—Christopher P. Ellis
*Assistant Examiner*—Katy Meyer
(74) *Attorney, Agent, or Firm*—Collard & Roe, P.C.

(57) ABSTRACT

The invention relates to a coupling device (1) between a sports shoe (2) and sports device (3), with a toe piece (5) and a heel piece (6) and a brake device (7) mounted between the latter for the sports device (3), with a longitudinal guide (9, 10) mounted on the surface (8) of the sports device (3) for the heel piece (6), in which the heel piece (6) is guided laterally and vertically in dimensions perpendicular to the longitudinal direction. The brake device (7) is provided with guiding elements (14, 15) that can engage in the guiding track (12, 13) of the longitudinal guide (9, 10) and between the brake device (7) and the heel piece (6), a longitudinal coupling device (19) is arranged for mobile connection with the heel piece (6) and the brake device (7) is guided in a play-free manner exclusively by the guiding track (12, 13) in all dimensions running perpendicular to the longitudinal direction of the guiding track (12, 13).

7 Claims, 4 Drawing Sheets

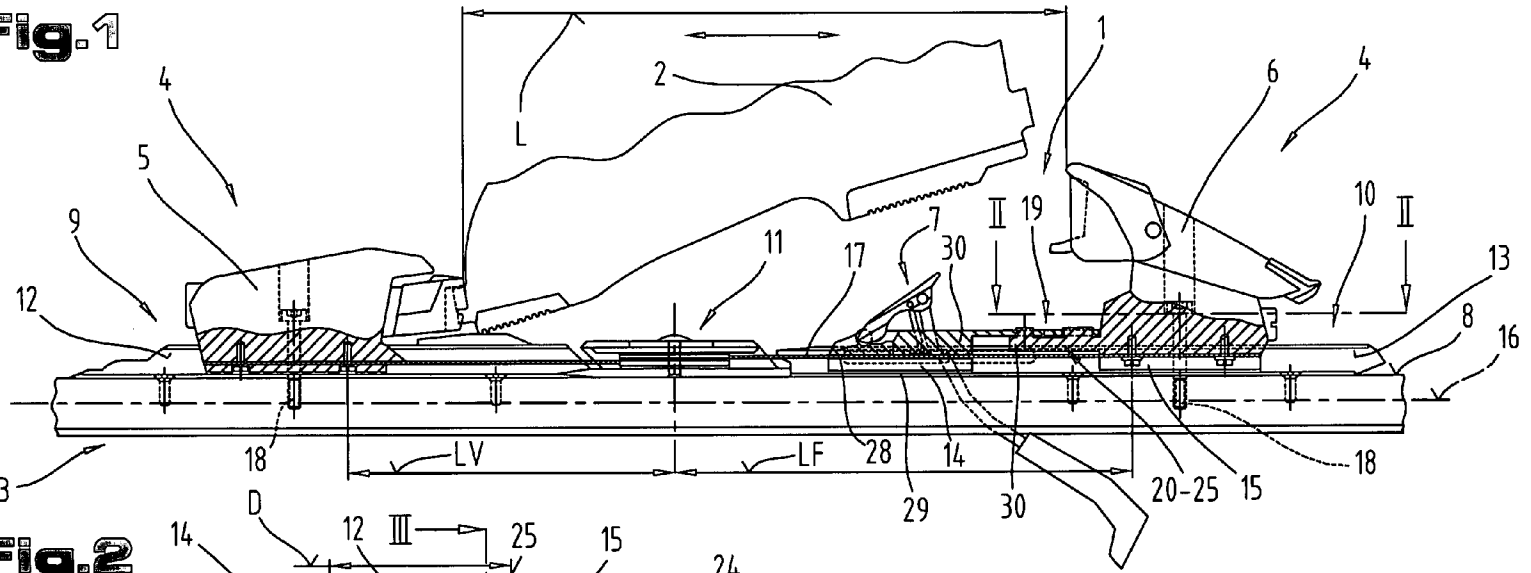
Fig. 1
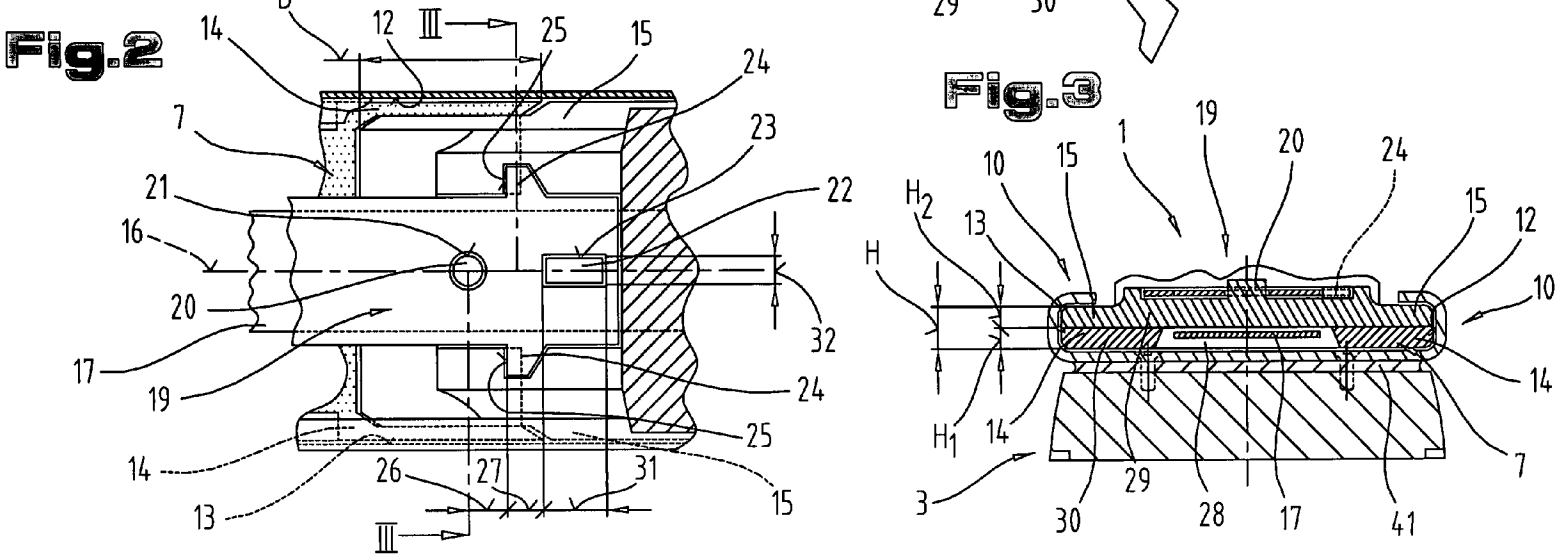
Fig. 2
Fig. 3

COUPLING DEVICE

BACKGROUND OF THE INVENTION

1. Field of the Invention

The invention relates to a coupling device between a sports shoe and a sports device, as described in the preamble of claim 1.

2. Prior Art

Ski bindings are already known, which consist of several, separate individual parts securable to the ski, such in a toe piece, heel piece, rear piece and a brake device arranged between the latter with pivotable brake arms. Whereas in many of these ski bindings, the individual binding parts are secured independently of one another by screws onto the sports device, in particular to the ski, a different category of ski binding is designed such that the toe and heel pieces are mounted displaceably, preferably independently of one another or at least relative to one another in guiding tracks secured to the ski in longitudinal direction of the guiding track on the ski. The brake device is here secured independently onto the ski between the toe and heel piece. To adjust the relative position or the relative spacing between the toe and heel pieces in order to adjust to different shoe sizes, the toe and heel piece are mostly adjustable by means of spacing bands, which are engaged in various different relative positions and fixed. Here the position of the toe and heel piece changes over the length of the longitudinal guide tracks depending on the respective shoe size. It is a disadvantage in this case that the force required to pivot the brake arms of the brake device when climbing into the ski binding on using the coupling device varies and also the function of the brake device cannot be ensured in all cases.

OBJECTIVES AND ADVANTAGES OF THE INVENTION

The underlying objective of the present invention is to enable the optimum positioning of the brake device in relation to the heel piece of the coupling device between a sports shoe and sports device.

This objective is achieved by means of the features in the characterising part of claim 1. The advantage of this solution is that here a fixed, constant distance can be achieved between the brake device and the locking elements of the rear piece or the rear piece itself, and with each change in position of the rear piece relative to the ski the brake device is moved necessarily with the latter at a constant relative distance from the rear piece in the longitudinal guiding track. In this way a constant distance is achieved of the brake device and mainly the operating pedal for pivoting the brake arm and even with larger shoe sizes on climbing into the ski binding the required force can be applied for lifting and pivoting the brake arms without an additional application of force.

The further development according to claim 2 has the advantage that the spacing between the brake device and the rear piece can be preset to adapt to extremely varying shoe sizes and during the displacement of the rear piece, for example with bindings with a central securing point or only one securing point in the region of the toe piece on the ski, the brake device can also be moved on displacing the heel piece relative to the ski. In this way the ski is given much greater flexibility, i.e. unwanted stiffening of the ski is prevented. Furthermore, it is not necessary to provide any separate fixings between the heel piece and the brake device, as the coupling elements in their engaging and locking position, in which the longitudinal distance between the brake device and heel piece is defined, are fixed securely in position relative to one another by fixing and guiding in the guiding track. The essentially play-free guiding is understood here to mean that the play between the opposite guiding elements of the guiding track is less than the thickness of the two coupling elements corresponding to this distance relative to the overlapping distance.

The embodiment according to claim 3 also make it possible for the unit consisting of the brake device and the brake piece to be supplied and installed as one piece. This is also improved by the features according to claim 4.

The further embodiment according to claim 5 has the advantage that the guiding tracks can be produced in one piece with the longitudinal guide as a U-shaped or C-shaped bent sheet metal part, whereby the base of the U- or C-shaped sheet metal part bears on the sports device and can be used for securing to the sports device.

An embodiment according to claim 6 is also advantageous, as thereby the connection between the two parts, namely the brake piece and the heel piece, is facilitated.

An embodiment according to claim 7 is advantageous, as since the coupling elements are in mutual engagement with one another, not only the tensile forces for securing the brake device longitudinally relative to the heel piece but also any torsional forces exerted in the operating position of the brake device by the brake arms on the brake device, are absorbed. The latter can however also be absorbed when using the coupling device or when inserting the sports shoe between the toe and heel piece.

By means of the further embodiment according to claim 8, a high strength, stressable connection is obtained, which also has multiple security, whereby if for example a tooth element breaks out subsequently, the mounting of the coupling parts relative to one another is reliably ensured.

The embodiments according to claims 9 and 10 provide a highly secure shoe connection in the longitudinal direction of the longitudinal guiding track between the brake device and the heel piece.

The embodiment according to claim 11 provides increased security of the connection between the brake device and the heel piece in a plane parallel to the standing surface of the coupling device, i.e. in the plane parallel to the surface of the sports device or ski surface.

It is advantageous with this development according to claim 12 that by means of the profile which extends over a part of a guiding plane of the heel piece a minimum holding force is obtained between the brake device and the heel piece. A further advantage of this design is achieved if the design of the retaining arms or the locking recesses extends over the entire width of the coupling device, so that no further additional parts are required for the coupling device.

The development according to claim 13 is advantageous as it is thereby possible to set a preadjustment and the unit formed by the brake device and the heel piece can be handled as a one-piece component.

The design of the coupling elements and locking elements according to claims 14, 15 and 16 permits adjustment to various conditions of use, such as for example children's ski bindings or racing ski bindings or the like.

BRIEF DESCRIPTION OF THE DRAWINGS

The invention is explained in more detail in the following with reference to the embodiments illustrated in the drawings. These show:

FIG. 1 a ski binding mounted onto the sports device with a coupling device according to the invention in side view, in partial cross section and in a much simplified schematic view;

FIG. 2 a part of a bottom plate/base plate with the coupling device according to the invention in plan view, in cross section along the lines II-II in FIG. 1, in a much simplified schematic view;

FIG. 3 the coupling device according to FIG. 2 in front elevation, in cross section along the lines III-III in FIG. 2;

DETAILED DESCRIPTION OF PREFERRED EMBODIMENTS

Figure 4:
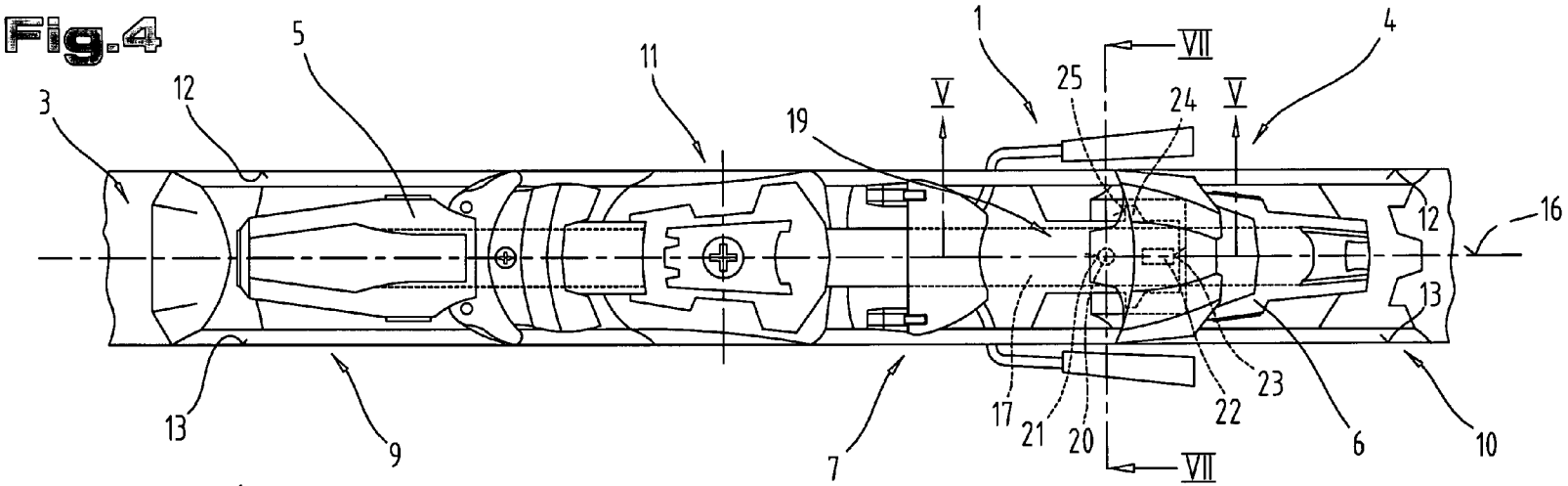
FIG. 4 a different embodiment of the coupling device according to the invention in plan view and in a much simplified schematic view.

Firstly, it should be noted that in all of the various described embodiments the same parts are given the same reference numbers and same component names, whereby the disclosures contained throughout the description can be applied to the same parts with the same reference numbers or same component names. Also the details on position used in the description such as e.g. top, bottom, side etc. refer to the figure currently being described and shown at the time and if there is a change in position these should be changed to relate to the new position. Furthermore, individual features or combinations of features of the embodiments shown and described represent in themselves independent, inventive solutions according to the invention.

In FIGS. 1 to 3 the structure of a standard coupling device 1 between a sports shoe 2 and a sports device 3, in the present case a ski binding 4, is shown. This comprises a toe piece 5 and heel piece 6 and a brake device 7 arranged in between. The toe piece 5 and the heel piece 6 are mounted so as to be displaceable along longitudinal guides 9, 10 mounted on the surface 8 of the sports device 3 in the longitudinal direction of the sports device 3, i.e. the ski. To position the toe and heel pieces 5, 6 in longitudinal direction of the sports device 3 and spaced apart from one another a central setting is provided by the adjusting and securing device 11.

The design of the adjusting and securing device 11 can be selected as desired from the embodiment variants known from the prior art, for example according to DE 41 35 899 A1 or DE 42 30 392 A1. Of course, instead of the central securing, i.e. the arrangement of the adjusting and securing device 11 between the toe and heel piece 5 or 6, any arrangement for adjusting and securing the toe and heel pieces 5, 6 relative to one another and relative to the sports device 3 is possible, as seen for example in DE 100 39 816 A1.

The design of the coupling device 1 according to the invention is thus basically independent of the type of adjusting and securing device 11 and can also be used for example if the toe piece 5 and the heel piece 6 are mounted separately from one another, for example positioned in the longitudinal guides 9, 10.

The adjustability of the toe and heel pieces 5, 6 in the longitudinal guides 9,10 relative to the sports device 3 is necessary in order to adjust the spacing L between the toe and heel pieces 5, 6 to different lengths of soles of sports shoes 2. In the coupling device 1 according to the invention both the heel piece 6 and the brake device 7 are provided with guiding elements 14, 15 projecting into groove-shaped guiding tracks 12, 13 formed on both sides of the longitudinal guides 9, 10. In this way the heel piece 6 and the brake device 7 can be guided laterally or vertically, i.e. perpendicular to the longitudinal direction of the longitudinal axis 16 of the sports device 3. The positioning of the heel piece 6 in the direction of the longitudinal axis 16 of the sports device 3 is hereby achieved by means of the centrally arranged adjusting and securing device 11, whereby the heel piece 6 is thereby secured via a connecting element 17 at a spacing $L_V$ and $L_F$ in front of the skifast securing point. Said connecting element 17 can be a high-strength traction element, for example a rope, chain or band. If a band is used, it is preferably a steel band, which at least in a direction perpendicular to the surface 8 of the sports device 3 has a much lower resistance to deformation than in its longitudinal direction or in the plane of the band in a direction perpendicular to the longitudinal direction. If the heel piece 6 is not secured only by a connecting element 17, the heel piece 6 can be secured in the desired position after a suitable displacement in the longitudinal guide 9, 10 by means of securing screws 18 projecting into the sports device 3 or can be secured and fixed onto the sports device 3.

According to the present invention, the brake device 7 is guided into its position in longitudinal direction of the sports device 3, e.g. on the ski or snowboard, in the direction of the longitudinal axis 16 with the projecting guiding elements 14 independently of the guiding elements 15 of the heel piece 6.

For longitudinal positioning in the direction of the longitudinal axis 16 of the sports device 3 between the heel piece 6 and the brake device 7 a longitudinal coupling device 19 is arranged. In this way the position of the brake device 7 is determined in the direction of the longitudinal axis 16 via the longitudinal coupling device 19 by the position of the heel piece 6. In addition, the longitudinal coupling device 19 is provided with mutually engaging coupling elements 20, 21, 22, 23, 24, 25.

Said coupling elements 20 to 25 interconnect almost in a play-free manner or with little play so that tensile and pressure forces acting in the direction of the longitudinal axis 16 can be transferred from the brake device 7 to the heel piece 6 and vice versa. In addition, they are also designed so that several such coupling elements 20, 21 or 22, 23 or 24, 25 are arranged in the direction of the longitudinal axis 16 spaced apart from one another by spacings 26, 27.

It is essential in this case that at least two such pairs of coupling elements 20 to 25 arranged spaced apart 26, 27 from one another in the direction of the longitudinal axis 16 are provided, so that by means of the longitudinal coupling device 19 torsional forces can also be transferred. It is thereby possible for both pairs of coupling elements 20, 21 or 22, 23 to be arranged behind one another along a common longitudinal axis 16, but it is also possible however for the latter to be offset at right angles to the longitudinal direction to the longitudinal axis 16 like coupling elements 20, 21 or 22, 23 to coupling elements 24, 25.

Particularly if more than two such pairs of coupling elements 20, 21 or 22, 23 or 24, 25 are provided it is recommended to arrange the latter spaced apart, or offset relative to one another parallel to the surface 8 or the part of the surface 8 that supports the longitudinal coupling device 19. In this way greater torsional forces can be obtained in the plane of that part of the surface 8 which mounts the longitudinal coupling device 19.

Whereas in the drawing in FIG. 1 the arrangement—shown by solid lines—is such that the guiding elements 14, 15 of the heel piece 6 and the brake device 7 are arranged behind one another in the direction of the longitudinal axis 16, in an advantageous development—shown by solid lines in FIG. 2—it can be seen that the guiding elements 14, 15 of the heel piece 6 and the brake device 7 overlap in the direction of the longitudinal axis 16 by a distance "D" and are guided in the overlapping position inside the guiding track 12 and 13. In addition, the guiding elements 14, 15 have a height $H_1$, $H_2$—as shown in FIG. 3—which corresponds to a part of the height of the guiding tracks 12, 13 and the entire height of which is equal to or slightly smaller than the height H of the guiding tracks 12, 13. In this way even when subjected to strong blows and torsional stresses the brake device 7 can be secured firmly in longitudinal direction of the longitudinal axis 16 relative to the heel piece 6.

As shown in FIGS. 4 to 7, in this embodiment the connecting element 17 runs through a cavity 28 between a bottom plate 29 of the longitudinal guide 10 and a base plate 30 of the heel piece 6 and also in a cavity 28 between the base plate 30 of the brake device 7 and the bottom plate 29 of the longitudinal guide 10.

Figure 5:
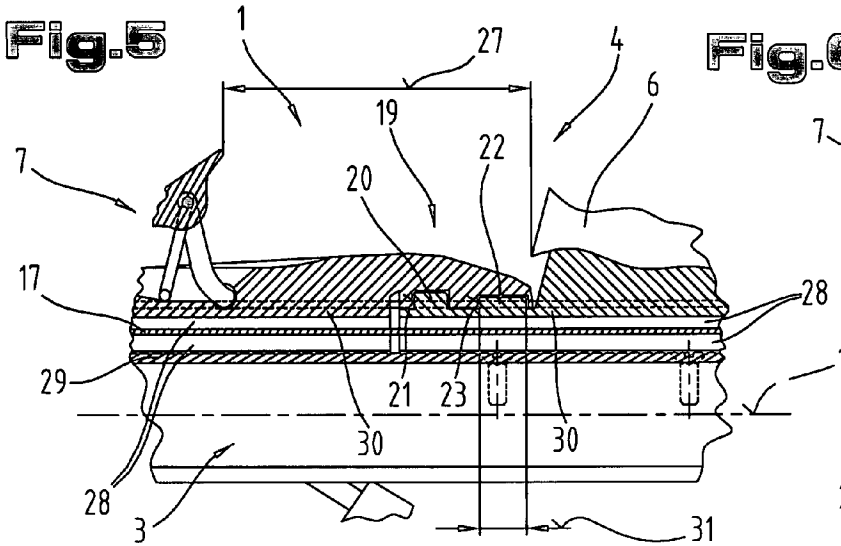
FIG. 5 a partial area of the coupling device according to the invention according to FIG. 4 in side view in cross section along the lines V-V of FIG. 4.

It can also be seen from the drawing in FIG. 5 that the base plates 30 of the heel piece 6 and the brake device 7 of the longitudinal coupling device 19 overlap in the direction of the longitudinal axis 16. In the overlapping area the coupling element 20, namely a pin, passes through the coupling element 21 formed by a bore in a direction running perpendicular to the longitudinal axis 16.

However, the coupling element 22 is formed by a quadrilateral shaped projection, the length 31 of which parallel to the longitudinal axis 16 is greater than a width 32 extending perpendicular to the longitudinal axis 16.

By means of the interaction of the coupling elements 20, 21 or 22, 23 which act as locking elements, a perfect coupling and a torsion-resistant connection is ensured between the heel piece 6 and the brake device 7 with the longitudinal coupling device 19.

If the brake device 7 with the longitudinal coupling device 19 is subjected to high stresses it can be advantageous to use additional coupling elements 24, 25 with solid locking elements in order to ensure mounting of the brake device 7 at the desired spacing 27 from the heel piece 6 in the direction of the longitudinal axis 16.

In this case it is advantageous if the locking elements are formed by trapezoid-shaped pins, which in the main direction of stress, namely tensile stress, have support devices aligned perpendicular to the longitudinal axis 16.

The counter locking element in the heel piece 6 is designed to be congruent.

By means of the surface division of the various forces acting on the connection between the brake device 7 and heel pieces 6 it is possible to obtain a high degree of durability and operational safety of the longitudinal coupling device 19.

Figure 6:
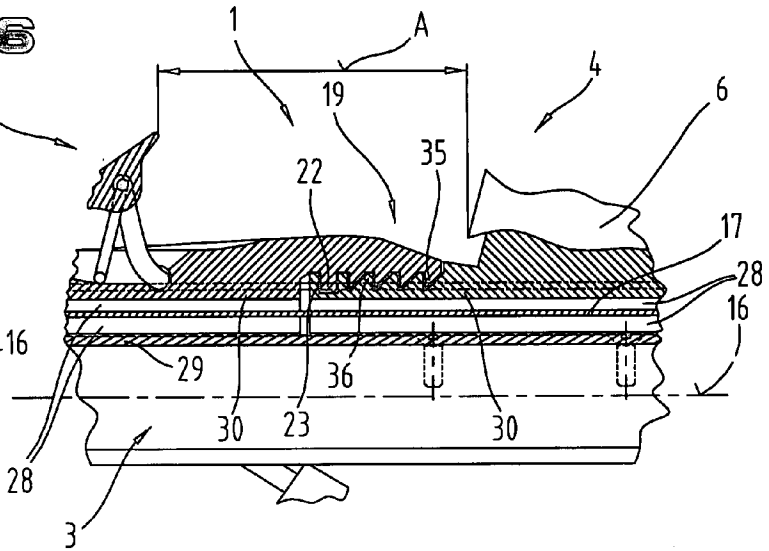
FIG. 6 a partial area of a variant of the coupling device according to the invention in side view in cross section along the lines V-V in FIG. 4.

A different embodiment is shown in FIG. 6. In this case the longitudinal coupling device 19 is formed by coupling elements 20, 21, whereby the coupling element 20 is formed by a row of teeth 35 and the coupling element 21 by a row of teeth 36.

In addition a coupling element 22 penetrates into an opening of the coupling element 23 forming the coupling element 23 for a better mounting of the brake device 7 relative to the heel piece 6. The connecting element 17 thereby runs between the base plate 30 of the brake device 7 and the bottom plate 29 in a cavity 28, e.g. a channel or tunnel, running parallel to the longitudinal axis 16 of the longitudinal coupling device 19, so that the movement of the heel piece 6 or the relative movement between the heel piece 6 and the sports device 3 is not hindered by the coupling device 1 of the heel piece 6 with the ski brake or brake device 7, and after a change in position the spacing A between the heel piece 6 and the brake device 7 can still be maintained.

In the overlapping area the coupling elements 20, 21 are formed by rows of teeth 35 of a tooth system running perpendicular to the longitudinal direction 16 of the guiding tracks 12, 13 and by a counter row of teeth 36.

Each of the rows of teeth 35, 36 has tooth elements aligned perpendicular to the longitudinal direction 16 of the longitudinal guiding track 9, 10 which have a cross section in the form of a right-angled triangle.

One of the legs of these tooth elements is aligned perpendicular to the longitudinal axis 16 of the guiding tracks 12, 13.

This means that a support of the tooth elements of the two rows of teeth 35, 36 mounting a push connection is aligned perpendicular to the bottom plate 29 of the longitudinal guides 9, 10 and is thereby highly stressable. Furthermore, by means of the perpendicular abutting of the tooth elements of the tooth system and countertoothing a high degree of torsion resistance is achieved.

Figure 7:
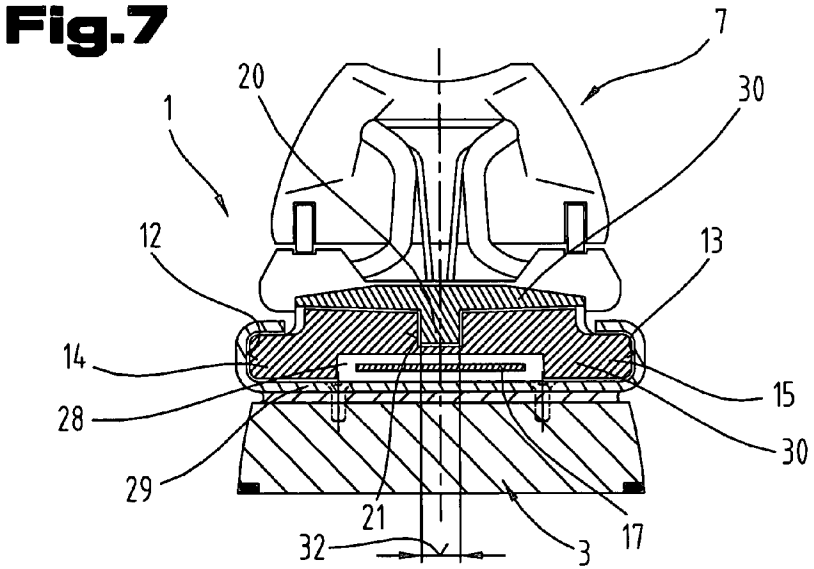
FIG. 7 a view of the coupling device according to the invention according to FIG. 4 in front elevation in cross section along the lines VII-VII in FIG. 4.

FIG. 7 shows a better illustration of the coupling elements 20, 21.

Figure 8:
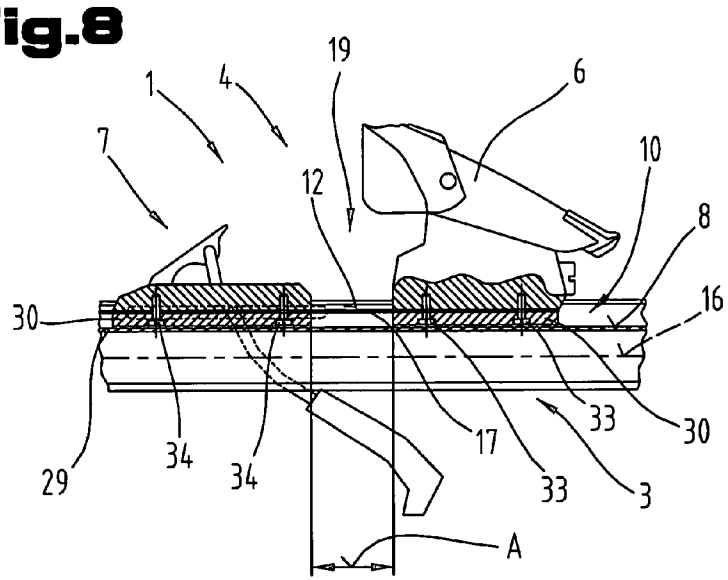
FIG. 8 a partial area of the coupling device according to the invention in a further variant, in side view in cross-section and in a much simplified schematic view.
Figure 9:
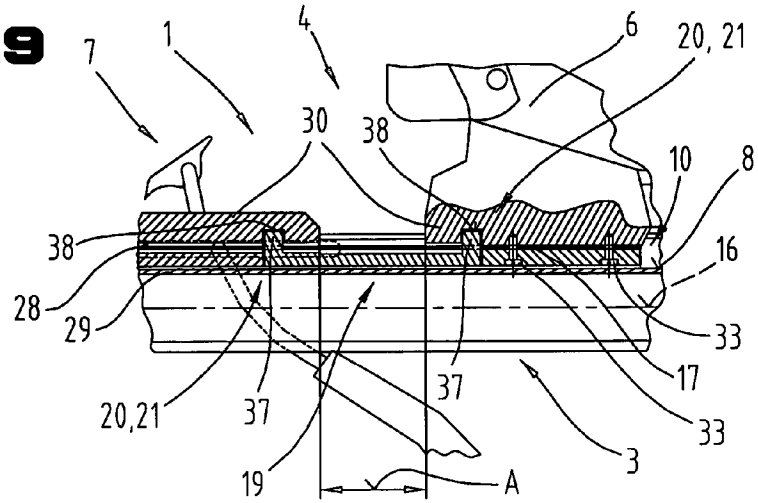
FIG. 9 a further variant of the coupling device according to the invention in side view, in cross section and in a much simplified schematic view.

FIGS. 8 and 9 show a further independent embodiment of the longitudinal coupling device 19, in which the same reference numbers have been used for the same parts as in the preceding FIGS. 1 to 7.

It can be seen from the embodiment in FIG. 8 that for maintaining the spacing and coupling the heel piece 6 and the brake device 7 the connecting element 17 is used. The spacing is maintained in that in addition to the connection of the connecting element 17 via the screw connection 33 to the heel piece 6 via screw connections 34 the base plate 30 of the brake device 7 is connected securely to the connecting element 17.

This means that on the one hand with a free sliding heel piece arrangement 6, as is usual using such connecting elements 17, the brake device 7 can be pushed along in the guiding track 12, 13 together with the heel piece 6 and this results a corresponding load balancing, whereby the elasticity of the sports device 3 cannot be influenced subsequently. By selecting a suitable setting the preselection of the spacing A between the brake device 7 and the heel piece 6 is possible.

In the embodiment in FIG. 9 however a longitudinal coupling device 19 is used which comprises the coupling element 20, 21 with a retaining arm 37 for the heel piece 6 and a retaining arm 37 for the brake device 7.

A detent recess 38 is allocated to said retaining arms 37 in the heel piece 6 and the brake device 7.

The coupling elements 20, 21 are snapped with their retaining arms 37 to form a unit consisting of a heel piece 6 and a brake device 7 into the detent recesses 38 and pushed as a complete unit with the guiding elements 14, 15 into the guiding tracks 12, 13 of the longitudinal guide 10. Because the total thickness of the coupling parts 20, 21 corresponds to the height of the tunnel remaining between the base plate 30 of the brake device 7 and the heel piece 6 and the bottom plate 29 of the longitudinal guide 10 and in each case has such a height that even in unfavourable cases the retaining arms 37 still project into the detent recesses 38, there cannot be an uncoupling between the coupling element 21 of the brake device 7 and the heel piece 6.

If the heel piece 6 is connected with a central adjusting securing device or with the toe piece 5 via a connecting element 17, the latter can also be arranged or guided between the coupling element 21 and the base plate 30. The retaining arms 37 in the detent recesses 38 are then designed either so that they come to rest on either side of the connecting element 17 or so that the connecting element 17 is preferably provided with a longitudinal hole so that the retaining arms 37 or parts of these retaining arms 37 can project through these connecting elements without disturbing their function.

By pushing in the unit consisting of the heel piece 6 and brake device 7 the separation of these parts is prevented in all dimensions by the guiding tracks 12, 13 and the latter are maintained relative to one another at the spacing A.

Instead of the embodiment variant shown in FIGS. 8 and 9 in which the longitudinal guide 9 or 10 can be formed by a part having a U- or C-shaped cross section made preferably by bending from a flat section of sheet metal, it is also possible for the longitudinal guides 9 and 10 to have a T-shape, whereby the vertical leg of the T-profile is mounted on the sports device 3 and the laterally projecting legs can engage in corresponding guides of the brake device 7 or heel piece 6.

The guiding elements thereby secure the brake device 7 and the heel piece 6 via the guiding tracks 12, 13 parallel to the longitudinal axis 16 in the case of tensile, pressure, torsional or bending stresses, and at the same time permit displacement and relative movement between the heel piece 6 or the brake device 7 and the sports device 3. The rows of teeth and the coupling elements or the retaining arms or detent recesses can extend over the entire width between the guiding elements 14, 15 of the brake device 7 or heel piece 6 or only over parts of the width.

Figures 10, 11:
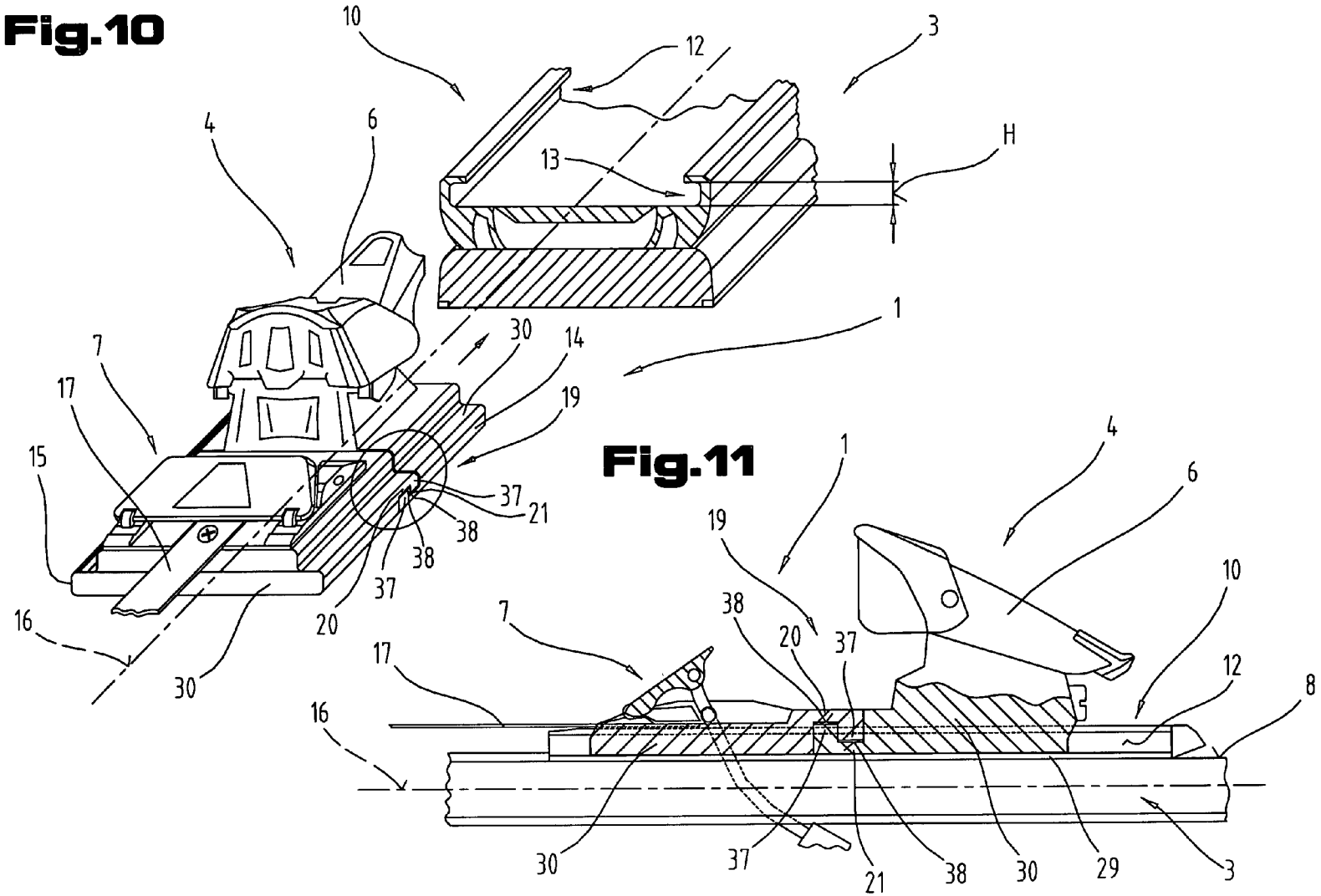
FIG. 10 a partial area of a different coupling device according to the invention in a diagrammatic and much simplified schematic view.
FIG. 11 a view of the coupling device according to FIG. 10 in side view in cross section and in a much simplified view.

In the embodiment shown in FIGS. 10 and 11 of the longitudinal coupling device 19 the respective base plate 30, for example of the heel piece 6, is provided on the side facing the brake device 7 with a projecting coupling arm 20 or 21. Said coupling arms comprise only part of the height H of the guiding tracks 12 or 13 of the longitudinal guide 10.

In the end region of the overlapping coupling elements 20, 21 in the direction of the opposite lying coupling elements 20, 21 projecting holding arms 37 are arranged which project into mutual detent recesses 38 of the respective opposite coupling element 20, 21. In this way the brake device 7 and the heel piece 6 can be snapped into one another and as a one piece component pushed into the longitudinal guide 10. Since the height H of the guiding tracks 12, 13 do not become detached, when the sum of the heights $H_1$ and $H_2$ of the guiding elements 14, 15 corresponds roughly to this height H even in the region of the overlapping coupling elements 20, 21, i.e. the holding arms 37 remain in engagement with the detent recesses 38, in this way a highly stressable, secure positioning and mounting of the brake device 7 relative to the heel piece 6 is achieved.

For form's sake it should be noted that for a better understanding of the structure of the coupling device 1 the latter or its components have not been drawn to scale and/or have been enlarged and/or reduced in size.

The embodiments show possible embodiments of the coupling device 1, whereby it should be noted at this point that the invention is not restricted to the specially illustrated embodiments but rather diverse combinations of the individual embodiments are possible and this variability due to the teaching on technical procedure of the present invention lie within the ability of a person skilled in the art. Thus all conceivable embodiment variants are also covered by the scope of protection which are possible by combining individual details of the embodiment variants shown and described.

Mostly the individual embodiments shown in detail in FIGS. 1-3; 4-7; 8; 9; 10-11 can form the subject matter of independent solutions according to the invention. The relevant objectives and solutions according to the invention can be taken from the detailed descriptions of these figures.

LIST OF REFERENCE NUMBERS

1. Coupling device
2. Sports shoe
3. Sports device
4. Ski binding
5. Toe piece
6. Heel piece
7. Brake device
8. Surface
9. Longitudinal guide
10. Longitudinal guide
11. Adjusting and securing device
12. Guiding track
13. Guiding track
14. Guiding element
15. Guiding element
16. Longitudinal axis
17. Connecting element
18. Securing screw
19. Longitudinal coupling device
20. Coupling element
21. Coupling element
22. Coupling element
23. Coupling element
24. Coupling element
25. Coupling element
26. Spacing
27. Spacing
28. Cavity
29. Bottom plate
30. Base plate
31. Length
32. Length
33. Screw connection
34. Screw connection
35. Row of teeth
36. Row of teeth
37. Retaining arm
38. Detent recess
A Spring
D Distance
H Height
$H_1$ Height
$H_2$ Height
L Spacing
$L_F$ Spacing
$L_V$ Spacing

The invention claimed is:

1. A coupling device between a sports shoe and a longitudinally extending sports device having a surface supporting (a) a toe piece, (b) a heel piece, (c) a brake device for the sports device, the brake device being arranged between the toe piece and the heel piece, (d) a longitudinal guide for the heel piece, the heel piece being laterally and vertically guided in a guide track of the longitudinal guide perpendicularly to the longitudinally extending sports device, (e) the brake device having guiding elements engaging the guide track for guiding the brake device play-free in the guide track in all directions extending perpendicularly to the longitudinally extending sports device, and (f) a longitudinal coupling device arranged between the brake device and the heel piece for connecting the brake device and the heel piece for common movement, the longitudinal coupling device comprising (1) locking elements consisting of rows of interengaging teeth extending parallel in the direction of the guide track, and (2) the teeth having a cross section perpendicularly to the guide track which has the form of a right-angle triangle, one of the triangle legs extending perpendicularly to the longitudinally extending sports device.

2. The coupling device of claim 1, wherein the guide track is comprised of two opposite, U-shaped guiding grooves open towards each other.

3. The coupling device of claim 1, wherein the guide track is comprised by laterally projecting longitudinal guiding strips.

4. The coupling device of claim 1, further comprising a high-strength sliding connection between the braking device and the heel piece, the sliding connection extending parallel to the longitudinally extending sports device.

5. The coupling device of claim 1, wherein the teeth are made from a highly stressable material of high tensile strength.

6. The coupling device of claim 5, wherein the material is a plastic.

7. The coupling device of claim 5, wherein the material is a metal.

* * * * *